US007711309B2

(12) United States Patent
Okazaki

(10) Patent No.: US 7,711,309 B2
(45) Date of Patent: May 4, 2010

(54) SHEET FEEDING DEVICE AND A CLEANING MEMBER IN SLIDING CONTACT WITH A CONVEYING UNIT

(75) Inventor: Shigeru Okazaki, Musashimurayama (JP)

(73) Assignee: Konica Minolta Business Technologies, Inc. (JP)

( * ) Notice: Subject to any disclaimer, the term of this patent is extended or adjusted under 35 U.S.C. 154(b) by 454 days.

(21) Appl. No.: 11/713,843

(22) Filed: Mar. 5, 2007

(65) Prior Publication Data

US 2007/0231033 A1 Oct. 4, 2007

(30) Foreign Application Priority Data

Apr. 4, 2006 (JP) ..... 2006-102847

(51) Int. Cl.
*G03G 15/00* (2006.01)

(52) U.S. Cl. ..... 399/388; 399/343; 399/353; 399/98

(58) Field of Classification Search ..... 399/343, 399/353, 411, 98; 271/109, 119
See application file for complete search history.

(56) References Cited

U.S. PATENT DOCUMENTS 6,055,407 A * 4/2000 Inoue et al. ..... 399/381
6,450,494 B1 * 9/2002 Adema ..... 271/122
2007/0201919 A1 * 8/2007 Okazaki ..... 399/388
2007/0257424 A1 * 11/2007 Okazaki ..... 271/264

FOREIGN PATENT DOCUMENTS

| | | |
|---|---|---|
| JP | 8-314344 | 11/1996 |
| JP | 11-52641 | 2/1999 |
| JP | 11-208918 | 8/1999 |
| JP | 2004-137076 | 5/2004 |
| JP | 2004-224451 | 8/2004 |

OTHER PUBLICATIONS

Machine Translation of JP 2004-137076.*

* cited by examiner

*Primary Examiner*—Ren Yan
*Assistant Examiner*—Matthew G Marini
(74) *Attorney, Agent, or Firm*—Cantor Colburn LLP

(57) ABSTRACT

A sheet feeding device includes: a conveying member of a conveying unit which conveys a sheet; and a cleaning member which is in sliding contact with a circumferential surface of the conveying member to clean the circumferential surface. The conveying member and the cleaning member rotate in the same tangential direction at a sliding contact position thereof, and drives of the conveyance member and the cleaning member are controlled so that the following expression is satisfied:

$$V1>V2$$

where V1 represents a line speed of the circumferential surface of the conveying member during a rotation thereof, and V2 represents a line speed of a sliding contact portion of the cleaning member during a rotation thereof.

7 Claims, 5 Drawing Sheets

| | AFTER NUMBER OF SHEETS FED | 1 | UP TO 200 | UP TO 300 | UP TO 900 | UP TO 1,500 | UP TO 2,000 | UP TO 3,000 | UP TO 5,000 | UP TO 7,000 | UP TO 9,000 |
|---|---|---|---|---|---|---|---|---|---|---|---|
| d | FIXED BRUSH | 1.52 | 0.72 | | | | | | | | |
| a | V1 > V2 | 1.52 | 1.61 | 1.63 | 1.71 | 1.72 | 1.62 | 1.65 | 1.59 | 1.62 | 1.62 |
| b | V1 < V2 | 1.52 | 1.55 | 1.43 | 1.57 | 1.52 | 1.46 | 1.51 | 1.49 | 1.47 | 1.49 |
| c | REVERSE ROTATED BRUSH | 1.52 | 1.13 | 1.18 | 1.33 | 1.38 | 1.33 | 1.34 | 1.34 | 1.19 | 1.29 |
| e | LOWER LIMIT PERFORMANCE | 1 | 1 | 1 | 1 | 1 | 1 | 1 | 1 | 1 | 1 |

SHEET FEEDING DEVICE AND A CLEANING MEMBER IN SLIDING CONTACT WITH A CONVEYING UNIT

This application is based on Japanese Patent Application No. 2006-102847 filed on Apr. 4, 2006, the content of which is hereby incorporated by reference.

BACKGROUND OF THE INVENTION

The present invention relates to a sheet feeding device used for an image forming apparatus such as a copier, a printer, a facsimile, and a multi-functional machine having the functions thereof and more particularly to a sheet feeding device having a cleaning member for removing foreign substances such as paper dust adhered to the outer peripheral surface of a conveying member and an image forming apparatus having the sheet feeding device.

Conventionally, a foreign substance removing device of the image forming apparatus makes a fixing type cleaning member (a flexible member such as a brush, felt, or a PET sheet) touch a roller member for conveying recording sheets, thereby removes foreign substances such as paper dust. Further, it makes a cleaning roller (a brush, felt, etc.) touch conveyed recording sheets, thereby removes foreign substances such as paper dust.

For example, Unexamined Japanese Patent Application Publication No. 11-52641 discloses a foreign substance removing device for making a fixed type cleaning member such as felt touch a conveying roller, thereby cleaning the surface of each recording sheet by the conveying roller.

Unexamined Japanese Patent Application Publication No. 11-208918 makes a brush touch a cleaning roller for cleaning conveyed recording sheets, thereby cleans the cleaning roller.

Unexamined Japanese Patent Application Publication No. 08-314344 is of a type of making a cleaning roller touch conveyed recording sheets.

Unexamined Japanese Patent Application Publication No. 2004-224451 makes a rotating brush roller touch a conveying roller, thereby cleans the conveying roller, makes a rotary roller touch the brush roller, thereby cleans the brush roller, and furthermore makes a flexible sheet touch the brush roller, thereby cleans the rotary roller.

Unexamined Japanese Patent Application Publication No. 2004-137076 (paragraph 0101, FIG. 9(a)), in a case that a conveying roller and a foreign substance removing member are rotated in the opposite direction and a case that they are rotated in the same direction, provides a speed difference between the moving speed of the tip of the foreign substance removing member and the moving speed of the peripheral surface of the conveying roller.

When feeding recorded sheets, particularly offset-printed sheets to the sheet feeding device arranged in the image forming apparatus or finisher, dusting powder or ink sludge adhered to a sheet and a coating agent on the sheet surface are adhered to the outer peripheral surfaces of the feed roller and conveying roller, thus the conveying force of the feed roller and conveying roller is lowered, and the sheet conveying performance becomes unstable. Therefore, it is necessary to clean the conveying roller.

However, in the foreign substance removing device for making a fixing type cleaning member touch the aforementioned feed roller and conveying roller, thereby removing foreign substances or making a cleaning roller such as a rotating brush touch a conveyed transfer material, thereby removing foreign substances and in the image forming apparatus using it, foreign substances such as paper dust cannot be stably removed over a long period of time, thus a problem arises that entering of foreign substances into the transfer area cannot be reduced for a long time.

Further, in the feed roller system of a reverse roller type, foreign substance stains such as paper dust adhered to the rotary rollers such as the pickup roller and feed roller are cleaned by pressing a flexible member such as a raising member like moquette, foamed polyurethane, or a PET sheet to the rollers. However, the raising member and flexible member cannot separate scraped foreign substances from the rollers, so that the cleaning effect is not continued, and it is necessary to periodically clean or exchange the cleaning member and rollers.

In the image forming apparatus disclosed in Unexamined Japanese Patent Application Publication No. 11-52641, foreign substances such as paper dust are collected immediately in the cleaning member, and unremovable foreign substances such as paper dust are conveyed into the transfer area, thus there is a problem imposed in the durability.

In the image forming apparatus disclosed in Unexamined Japanese Patent Application Publication No. 11-208918, a speed difference is provided between the cleaning roller and the transfer material, so that a problem arises that an unstable element is given to conveyance of the transfer material.

In the image forming apparatus disclosed in Unexamined Japanese Patent Application Publication No. 08-314344, at the point of time when foreign substances such as paper dust are collected on the surface of the cleaning roller, the effect is lost and there is a problem imposed in the durability.

In the image forming apparatus disclosed in Unexamined Japanese Patent Application Publication No. 2004-224451, unless the rubber of the conveying roller and the material of the cleaning member are set appropriately, stable sheet conveyability and a high effect cannot be obtained.

In the foreign substance removing apparatus disclosed in Unexamined Japanese Patent Application Publication No. 2004-137076, when the conveying roller and brush of the foreign substance removing member are rotated in the opposite direction, it is described to make the brush touch the peripheral surface of the conveying roller so as to move relatively. However, the relationship between the moving speed of the sliding section of the front end of the brush and the moving speed of the outer peripheral surface of the conveying roller is not described.

Further, the pickup roller of the sheet feeding device must send surely sheets to the feed roller and the pressurizing force of the pickup roller to sheets must be set to an appropriate load. To give a stable and appropriate load, a system of applying pressurizing force by the own weights of the pickup roller and holder is effective. However, in this case, when the cleaning mechanism for cleaning the pickup roller is made larger, a problem arises that an appropriate load cannot be given.

SUMMARY OF THE INVENTION

An object of the present invention is to provide a sheet feeding device for eliminating the aforementioned faults, enabling removal of foreign substances such as paper dust over a long period of time, reducing entry of foreign substances into the transfer area, realizing miniaturization of the cleaning mechanism, and obtaining a good image quality and an image forming apparatus using the concerned device.

The above object can be accomplished by the structures indicated below.

1. A sheet feeding device having a cleaning member for cleaning the outer peripheral surface of a conveying member of a conveying unit for conveying sheets in sliding contact with it, wherein the conveying member and cleaning member are rotated in the same tangential direction at the sliding contact position, and assuming the linear speed of the outer peripheral surface of the conveying member during rotation as V1 and the linear speed of the sliding portion of the cleaning member during rotation as V2, so as to satisfy the relationship of V1>V2, the conveying member and cleaning member are controlled in driving.

2. An image forming apparatus comprising the sheet feeding device described in the above structure 1 and an image forming section for forming an image on a sheet fed from the sheet feeding device.

DETAILED DESCRIPTION OF THE PREFERRED EMBODIMENT

Next, the image forming apparatus of the present invention will be explained with reference to the accompanying drawings.

[Image Forming Apparatus]

Figure 1:
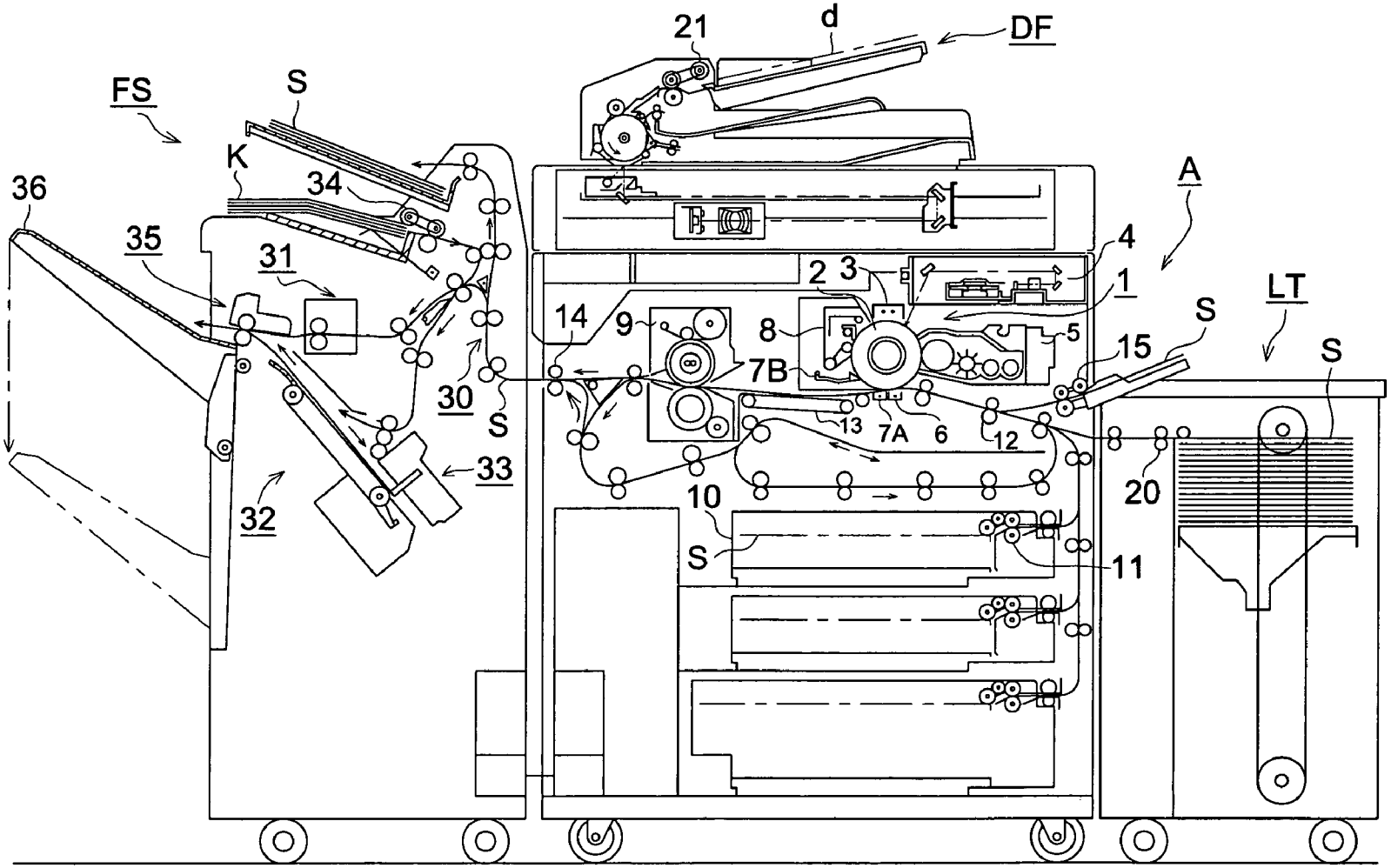
FIG. 1 is a schematic view of the image forming apparatus composed of the image forming apparatus main body, finisher, large capacity sheet feeding device, and automatic document feeder.

FIG. 1 is a schematic view of the image forming apparatus composed of an image forming apparatus main body A, a finisher FS, a large capacity sheet feeding device LT, and an automatic document feeder DF.

The image forming apparatus main body A includes an image forming section 1, a fixing device 9, and a sheet conveying system. The image forming section 1 is composed of a charging unit 3 arranged around an image carrier 2, an image exposure unit 4, a developing unit 5, a transferring unit 6, a discharging unit 7A, a separation claw 7B, and a cleaning unit 8.

The sheet conveying system is constituted by a first conveying section composed of a sheet feeding cassette (sheet storing section) 10, a first sheet feeding unit 11, a second sheet feeding unit 12, a conveying unit 13, a sheet ejecting unit 14, and a manual sheet feeding unit 15 and a sheet circulating and re-feeding section for circulating and re-feeding sheets S.

The sheet feeding cassette 10 and first sheet feeding unit 11 are formed by a plurality of sheet feeding units (three stories shown in FIG. 1) and store and feed the sheets S of several kinds of sizes.

The sheets S sent from a sheet feeding device 20 of the large capacity sheet feeding device LT are sent to the second sheet unit 12.

A document "d" loaded on the document table of the automatic document feeder DF is conveyed by a document feeding device 21 and the document image is read by the image reading device.

In the image forming section 1, the processes of charging, exposing, developing, transferring, separating, and cleaning are performed. Each of the sheets S sent from the sheet feeding cassette 10, manual sheet feeding unit 15, and large capacity sheet feeding device LT is transferred an image by the transferring unit 6. The sheet S carrying the image is fixed by the fixing unit 9, is ejected from the sheet ejecting unit 14, and is sent to the finisher FS.

The finisher FS is composed of an inlet conveying section 30, a shifting unit 31, a stacking unit 32, a stapling unit 33, a cover sheet feeding unit 34, and a sheet ejecting unit 35.

[Finisher]

Cover sheet K fed by the cover sheet feeding unit 34 is conveyed by the conveyance roller group and is stored in the stacking unit 32. The cover sheet K is stacked on a plurality of sheets S stored in the stacking unit 32 and form a front cover sheet and a back cover sheet. Further, the cover sheet K can be used as an inserting sheet inserted between the plurality of sheets S.

When sheets S of a predetermined number are stacked and aligned in the stacking unit 32, stapling needles are stuck at two locations of the sheets S or at one location in one corner of the sheets S by the stapling unit 33, thus the sheets S are bound, and a booklet is prepared.

The sheets S bound are interposed and conveyed by the sheet ejecting unit 35 and are ejected and stacked on a main tray 36.

[Sheet Feeding Device]

The sheet feeding device can be applied to the first sheet feeding unit 11 and manual sheet feeding unit 15 of the sheet feeding cassette (sheet storing section) 10 arranged in the image forming apparatus main body A, the sheet feeding device 20 of the large capacity sheet feeding device LT, the document feeding device 21 of the automatic document feeder DF, and the cover sheet feeding unit 34 of the finisher FS.

Figure 2:
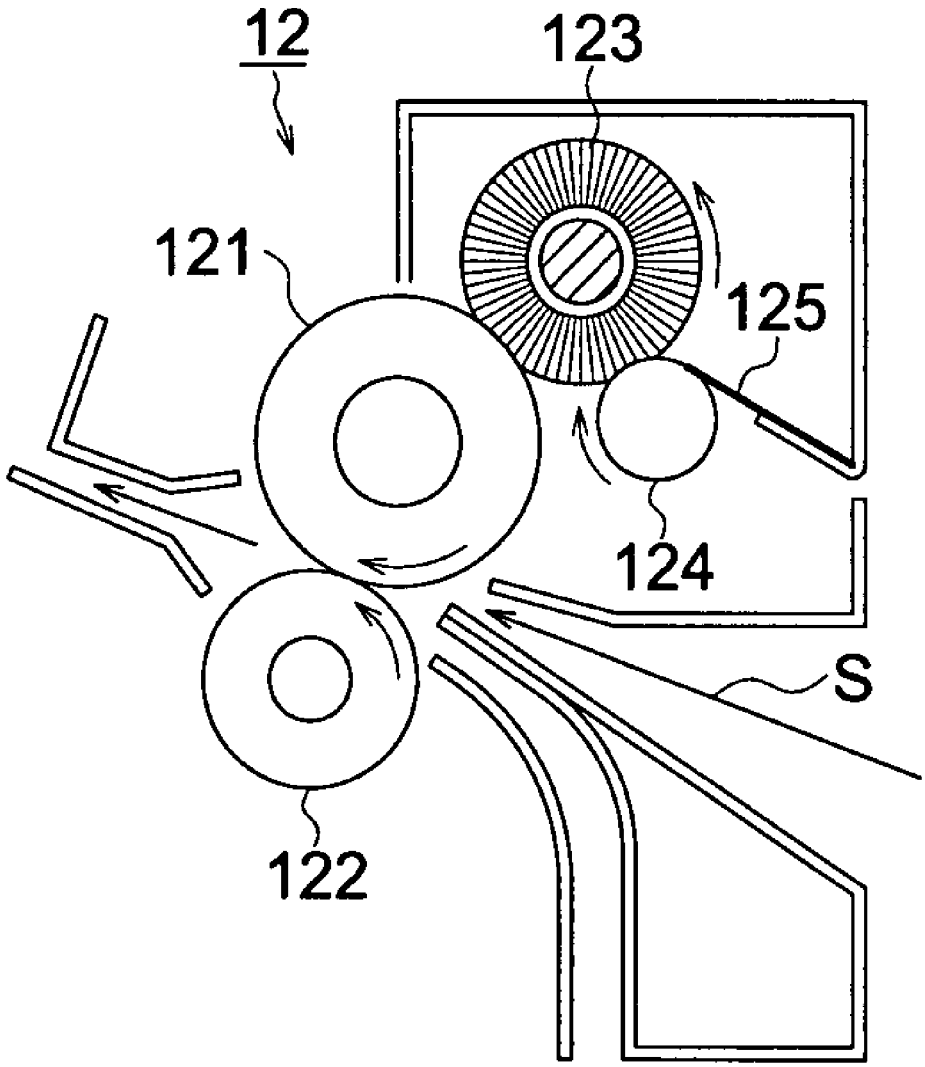
FIG. 2 is a cross sectional view of the second sheet feeding unit of the image forming apparatus main body.

FIG. 2 is a cross sectional view of the second sheet feeding unit 12 of the image forming apparatus main body A shown in FIG. 1.

The second sheet feeding unit 12 includes a first cleaning member (hereinafter, referred to as a cleaning brush) 123 composed of a drive roller (conveying member) 121 for interposing and conveying the sheets S, a driven roller 122, and a cleaning brush rotating in sliding contact with the drive roller 121, a second cleaning member 124 for rotating in sliding contact with the cleaning brush 123, and a third flexible cleaning member 125 in contact with the outer peripheral surface of the second cleaning member 124.

The drive roller 121 is driven to rotate clockwise, and the cleaning brush 123 is driven to rotate counterclockwise by a drive unit not drawn, and the second cleaning member 124 is driven to rotate clockwise by a drive unit not drawn. The third cleaning member 125 is in pressure contact with the outer peripheral surface of the second cleaning member 124 counter to the rotation thereof.

The cleaning brush 123 is formed by a conductive brush. The specifications and characteristics of the conductive brush will be described later. The specifications and characteristics of the drive roller 121 will also be described later.

Figure 3:
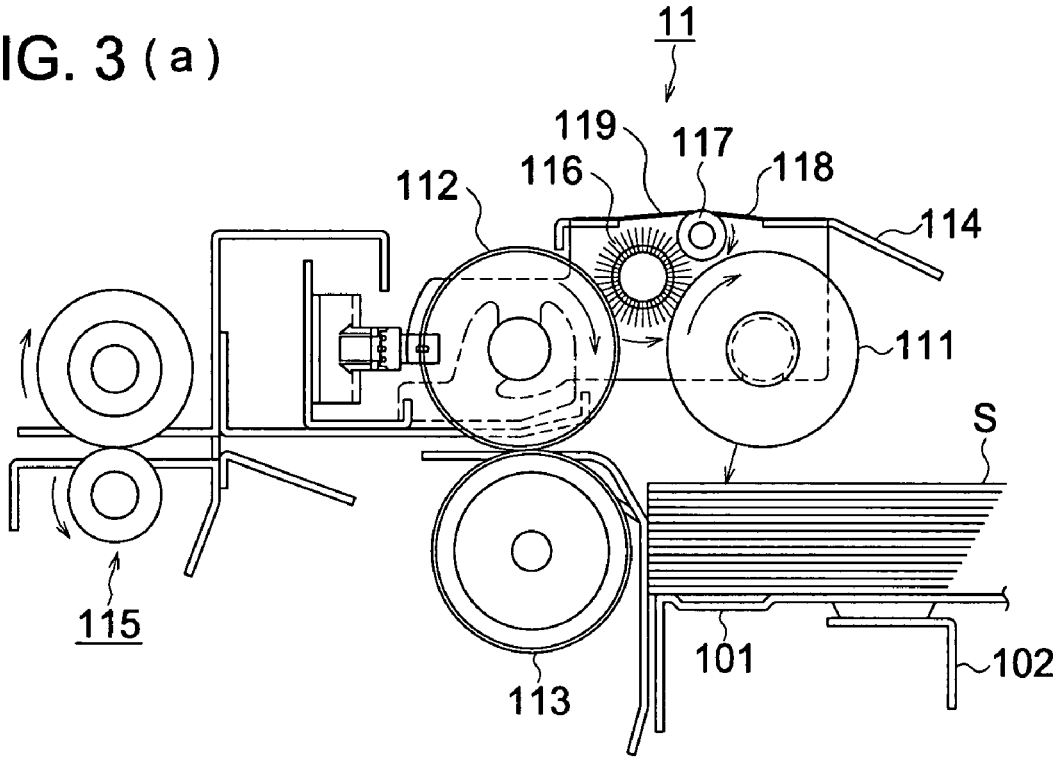
FIGS. 3(*a*) and 3(*b*) are plane cross sectional views of the sheet feeding device.
Figure 3:
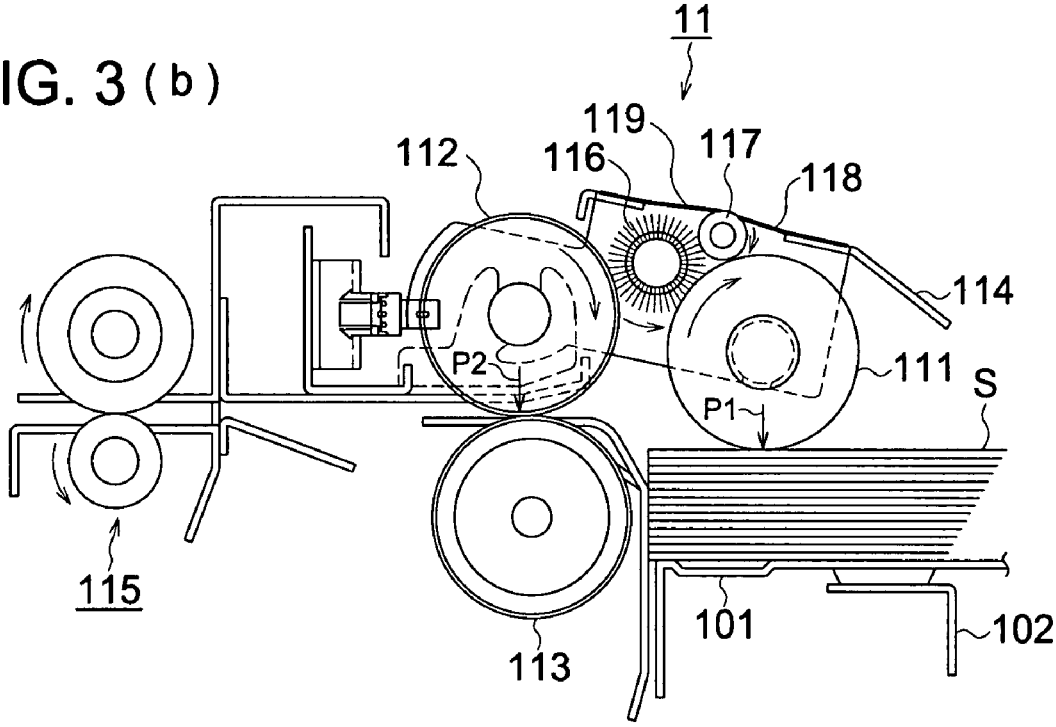

FIGS. 3(*a*) and 3(*b*) are plane cross sectional views of the sheet feeding device, and FIG. 3(*a*) shows the state before start of sheet feed, and FIG. 3(*b*) shows the state at time of sheet feed.

Further, the manual sheet feeding unit 15, the sheet feeding device 20 of the large capacity sheet feeding device LT, the document feeding device 21 of the automatic document feeder DF, and the cover sheet feeding unit 34 of the finisher FS have an almost similar structure as that of the first sheet feeding unit 11, so that hereinafter, the first sheet feeding unit 11 will be explained as representation.

The sheets S loaded on a rise-and-fall plate 101 in the sheet feeding cassette 10 move up by a rise-and-fall member 102 moving up and down by a motor not drawn and when the top of the sheets S reaches a predetermined position where it makes contact with the outer peripheral surface of a pickup roller (first conveying member) 111, the top of the sheets S is detected by a sensor not drawn, and the rise-and-fall plate 101 stops rising.

At the upper limit position of the sheets, a predetermined pressure P1 is applied to the top of the sheets S by the own weights of the pickup roller 111 and a holder 114.

By a sheet feed signal, the pickup roller 111 and a feed roller (second conveying member) 112 start rotation. The pickup roller 111 making pressure contact with the top of the sheets S at the predetermined pressure P1 sends the sheets S to the nip position between the feed roller 112 and a multi-feed prevention roller (reverse roller) 113, and then separates from the sheet surface.

The multi-feed prevention roller 113 is driven in the opposite direction of the conveying direction of the sheets S via a torque limiter not shown and makes pressure contact with the feed roller 112 at a predetermined pressure P2 by a spring not drawn.

The multi-feed prevention roller 113, when there exist no sheets S at the nip position and the feed roller 112 directly makes contact or when one sheet S is sent to the nip position, since the torque limiter slides at more than the limit torque, rotates by following the feed roller 112, thereby conveys the one sheet S.

However, when two or more sheets S are sent to the nip position, the limit torque overcomes the frictional force between the sheets, rotates reversely the multi-feed prevention roller 113, presses back the lower side sheets S, prevents feeding of a large number of sheets, thereby conveys one sheet S.

When the sheet feed start signal is input, the pickup roller 111 swings around the rotary shaft of the feed roller 112 and makes contact with the top of the sheets S by its own weight. Simultaneously, an electromagnetic clutch CL which will be described later is put into the connection state, and the feed roller 112 starts rotation, and furthermore, the pickup roller 111 starts rotation by a drive transmission unit which will be described later.

The sheets S are sent out by the rotation of the pickup roller 111, are conveyed to the nip position where the feed roller 112 and multi-feed prevention roller 113 make pressure contact with each other, are handled one by one, and reach a conveyance roller pair 115 on the downstream side in the conveying direction. Incidentally, the first sheet feeding unit 11 and the conveyance roller pair 115 constitute a conveying unit.

When a sensor not drawn detects arrival of the sheets S at the conveyance roller pair 115, the electromagnetic clutch CL enters the non-contact state, and the sheets S, by interposing and conveying by the conveyance roller pair 115, are pulled out and conveyed from the nip position where the feed roller 112 and multi-feed prevention roller 113 make pressure contact with each other.

[Cleaning Member]

On the first document feeding unit 11, above the space where the pickup roller 111 and feed roller 112 face each other, a first cleaning member (hereinafter, referred to as a cleaning brush) 116, a second cleaning member 117, a third cleaning member 118, and a covering member 119 are arranged.

The cleaning brush 116 rotates in sliding contact with the outer peripheral surface of the pickup roller 111 and the outer peripheral surface of the feed roller 112. The cleaning brush 116 is rotated by a driving unit, which will be described later and rotates counterclockwise as shown in the drawing. The cleaning brush 116 and pickup roller 111 rotate with a speed difference in the same direction at the sliding contact position. The cleaning brush 116 and feed roller 112 rotate with a speed difference in the same direction at the sliding contact position.

The cleaning brush 116 comes in sliding contact with the feed roller 112, thereby removes paper dust and foreign substances adhered to them.

Specification of the cleaning brush 116:

Brush of an electromagnetic acrylic material;

Thickness of bristles of 6.25 deniers (One denier means a thickness of fibers with a weight of 50 mg per a length of 450 m.)

Density of bristles of 100000 pieces per $(25.4\ \text{mm})^2$

Outside diameter of 16 mm

Length of bristles of 4 mm

Both the overlap amount of the pickup roller 111 and cleaning brush 116 and the overlap amount of the feed roller 112 and cleaning brush 116 are set at 0.5 mm to 1.5 mm.

The second cleaning member 117 is a rotary roller rotated by the driving unit in sliding contact with the cleaning brush 116. The second cleaning member 117 refreshes the cleaning brush 116 by removing paper dust and foreign substances adhered to it.

The third cleaning member 118 is formed by a flexible thin plate, for example, a PET (polyethylene terephthalate) sheet in contact with the outer peripheral surface of the second cleaning member 117. The tip portion of the third cleaning member 118 makes pressure contact with the outer peripheral surface of the second cleaning member 117 counter to the rotation thereof. The third cleaning member 118 removes paper dust and foreign substances adhered to the second cleaning member 117 and shields the space above the pickup roller 111.

The covering member 119 is arranged at the symmetrical position to the third cleaning member 118 and is formed by a flexible thin plate, for example, a PET (polyethylene terephthalate) or urethane sheet in contact with the outer peripheral surface of the second cleaning member 117. The tip portion of the covering member 119 is in slight contact with the outer peripheral surface of the second cleaning member 117 with trailing the rotation thereof. The covering member 119 removes paper dust and foreign substances adhered to the second cleaning member 117 and shields the space above the feed roller 112.

When taking out sheets S defective in conveyance in the first sheet feeding unit 11 and lifting up the pickup roller 111 and swinging upward around the feed roller shaft, the space above the cleaning brush 116 is covered with the third cleaning member 118 and covering member 119, so that paper dust and foreign substances around the second cleaning member 117 are prevented from leaking out.

When the brush of the cleaning member for cleaning the surface of the conveying roller in sliding contact with the conveying rubber roller is not conductive, the rubber roller surface is charged, and problems arise that stains due to paper dust and foreign substances adhered to the surface of the conveying rubber roller are hardly removed and the sheet surfaces are charged, thus in the transfer section of the image forming apparatus main body A, defective image transfer is caused. Therefore, it is preferable to give conductivity to the cleaning brush.

Particularly, the cleaning brush 116 for cleaning the pickup roller 111 and feed roller 112 must be miniaturized. However, the miniaturization has its limit and the outside diameter of the core bar wound with a raising brush must be about 6 mm at its minimum from the viewpoint of strength, though to fulfill a stable cleaning function, the outside diameter is preferably about 8 mm.

The bristle length of the cleaning brush 116 must be 3 mm or more. Therefore, when the core bar and bristle length are joined, the outside diameter of the cleaning brush 116 must be 14 mm or more.

[Rotation Driving Mechanism of the Cleaning Brush]

Figure 4:
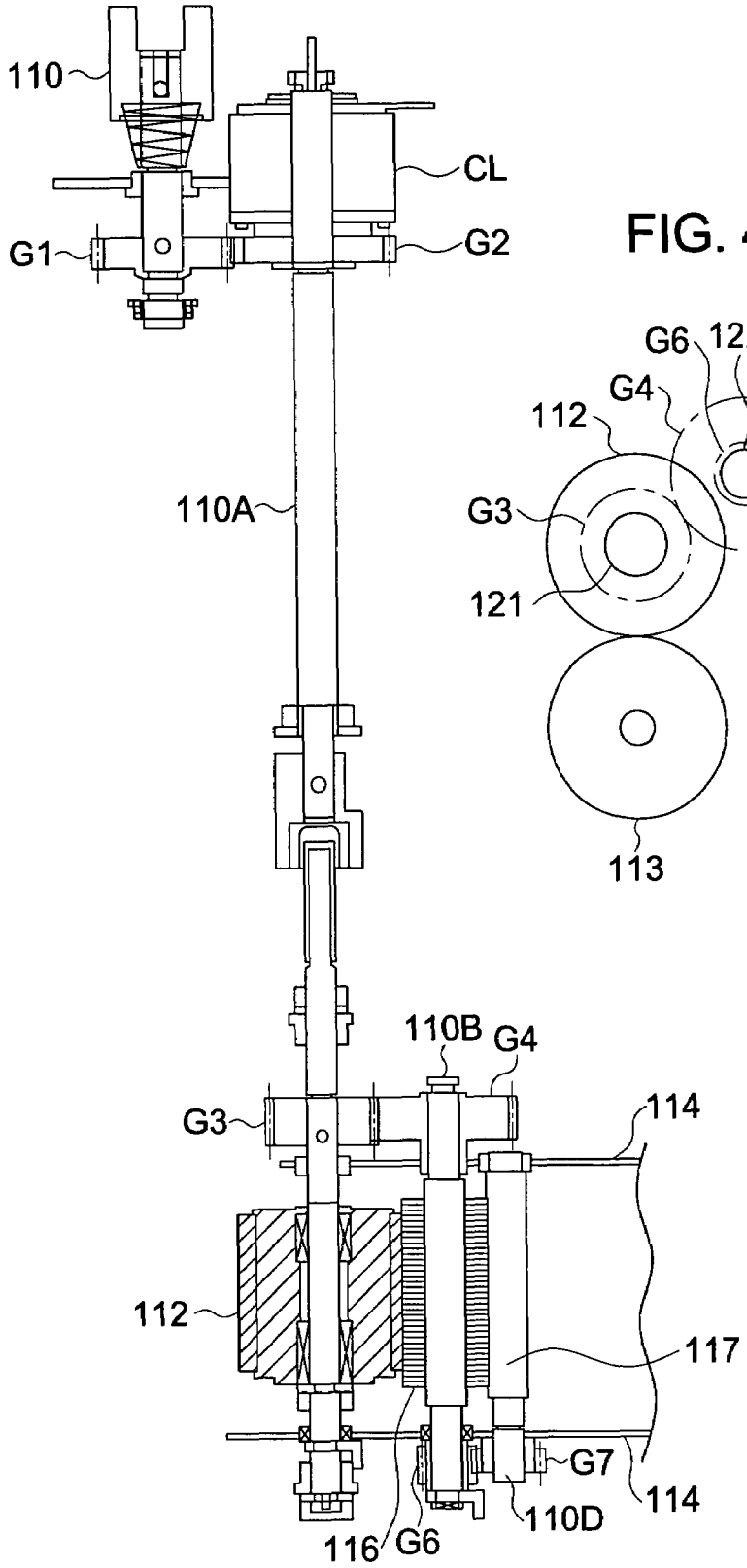
FIGS. 4(*a*) and 4(*b*) are a plane cross sectional view and a front view showing the rotation driving mechanism of the cleaning brush.
Figure 4:
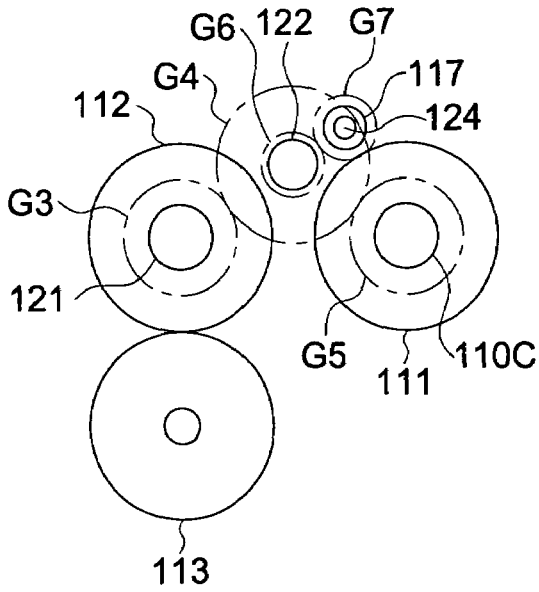

FIG. 4(*a*) is a plane cross sectional view showing the rotation driving mechanism of the cleaning brush 116 and FIG. 4(*b*) is a front view thereof.

A driving source not drawn is connected to a coupling 110 and rotates continuously a gear G1. The gear G1 meshes with a gear G2 and rotates a rotary shaft 110A. The electromagnetic clutch CL installed at the shaft end of the rotary shaft 110A turns on or off rotation drive of the rotary shaft 110A.

When the electromagnetic clutch CL enters the connection state, the rotary shaft 110A rotates and the feed roller 112 rotates clockwise as shown in the drawing. A gear G3 fixed to the rotary shaft 110A of the feed roller 112 rotates a gear G5 fixed to the shaft end of a rotary shaft 110C of the pickup roller 111 via a gear G4. Therefore, both the feed roller 112 and pickup roller 111, as shown in FIG. 4(*b*), rotate clockwise.

To a rotary shaft 110B of the gear G4, the cleaning brush 116 is fixed and rotates counterclockwise together with the rotary shaft 110B as shown in the drawing.

A gear G6 fixed to the other end of the rotary shaft 110B rotates a gear G7 fixed to a rotary shaft 110D of the second cleaning member 117. By the rotation of the gear G7, the second cleaning member 117 rotates clockwise as shown in the FIG. 2.

A holder 114 of the first sheet feeding unit 11 bears rotatably the rotary shaft 110A, rotary shaft 110B, and second cleaning member 117 and fixes the third cleaning member 118 and one end of the covering member 119. The tip portion of the third cleaning member 118 is in pressure contact with the outer peripheral surface of the second cleaning member 117 counter to the rotation thereof. The tip portion of the covering member 119 is in pressure contact with the outer peripheral surface of the second cleaning member 117 with trailing the rotation thereof.

The holder 114 of the first sheet feeding unit 11 is supported rotatably around the rotary shaft 110A of the feed roller 112. During sheet feed, the stop of the upper mechanism of the first sheet feeding unit 11 composed of the pickup roller 111, cleaning brush 116, second cleaning member 117, third cleaning member 118, covering member 119, and holder 114 is canceled and the pickup roller 111 swings and pressurizes the top of the sheets S stored in the sheet feeding cassette 10 at the predetermined pressure P1 by its own weight and sends out the sheets S.

The cleaning unit composed of the cleaning brush 116, second cleaning member 117, third cleaning member 118, and covering member 119 is formed small and light, so that it holds the predetermined pressure P1 and can send out surely a minimum number of sheets S.

Particularly, the cleaning brush 116 and second cleaning member 117 are installed compatibly with the pickup roller 111 and feed roller 112, thus the first sheet feeding unit 11 can be made smaller and lighter. By doing this, the degree of freedom of design of the first sheet feeding unit 11 having a constitution of sending appropriately sheets at the pressure by its own weight is made wider.

Further, foreign substances adhered to the surface of the pickup roller 111 from each surface of the sheets S and foreign substances adhered to the surface of the feed roller 112 from each surface of the sheets S are cleaned surely by the cleaning unit composed of the cleaning brush 116, second cleaning member 117, third cleaning member 118, and covering member 119.

Further, foreign substances adhered to the surface of the multi-feed prevention roller 113 from each rear of the sheets S and furthermore transferred to the feed roller 112 are also cleaned surely by the cleaning unit composed of the cleaning brush 116, second cleaning member 117, third cleaning member 118, and covering member 119.

Figure 5:
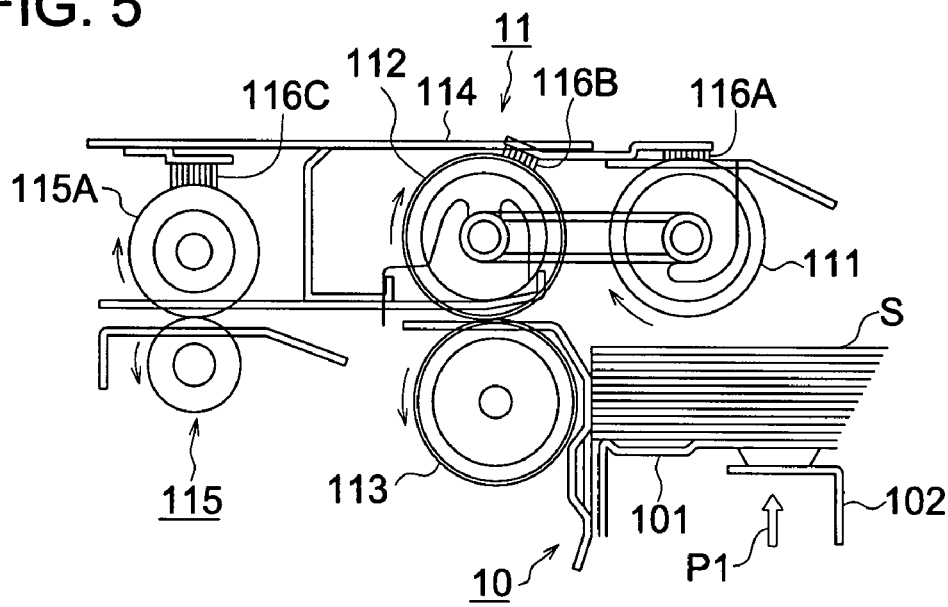
FIG. 5 is a cross sectional view of the cleaning unit of a comparative example having a fixed brush.

FIG. 5 is a cross sectional view of the cleaning unit of a comparative example having a fixed brush. Further, with respect to the numerals used in the drawing, to the same sheet feeding mechanism as that shown in FIG. 3, the same numerals are assigned.

On the upper part of the pickup roller 111, a cleaning member (cleaning brush) 116A fixed to the support plate is arranged. The cleaning member 116A removes foreign substances adhered to the outer peripheral surface of the pickup roller 111 in sliding contact with the outer peripheral surface of the pickup roller 111.

On the upper part of the feed roller 112, a cleaning member (cleaning brush) 116B fixed to the support plate is arranged. The cleaning member 116B removes foreign substances adhered to the outer peripheral surface of the feed roller 112 in sliding contact with the outer peripheral surface of the feed roller 112.

On the upper part of a drive roller 115A of the conveyance roller pair 115, a cleaning member (cleaning brush) 116 is arranged. The cleaning member 116C removes foreign substances adhered to the outer peripheral surface of the drive roller 115A in sliding contact with the outer peripheral surface of the drive roller 115A.

TABLE 1

| | | Feed roller (112) | | | | Cleaning brush (116) | | | |
|---|---|---|---|---|---|---|---|---|---|
| | Linear speed relationship | Outside diameter (mm) | Constant of gear G3 | Linear speed ratio (V1) | Overlap amount (mm) | Outside diameter (mm) | Constant of gear G4 | Linear speed ratio (V2) | Relative linear speed ratio V2 − V1 |
| Example | V1 > V2 | 32 | 33 | 1 | 1.23 | 16 | 23 | 0.72 | −0.28 |
| Comp. | V1 < V2 | 32 | 21 | 1 | 1.23 | 14 | 18 | 1.49 | 0.49 |

Comp.: Comparative example

Table 1 shows an example of the feed roller 112 and cleaning brush 116.

In FIGS. 4(*a*) and 4(*b*), the gear G3 fixed to the rotary shaft 110A of the feed roller 112 meshes with the gear G4 fixed to the rotary shaft 110B and rotates the cleaning brush 116.

Example

Assuming the outside diameter of the feed roller 112 as 32 mm, the number of teeth of the gear G3 as 33, the outside diameter of the cleaning brush 116 as 16 mm, and the number of teeth of the gear G4 as 23, for the linear speed V1 of the feed roller 112, the linear speed V2 of the cleaning brush 116 is 0.72, and the relative linear speed (V1−V2) is −0.28, and V1>V2 results.

Comparative Example

Assuming the outside diameter of the feed roller 112 as 32 mm, the number of teeth of the gear G3 as 21, the outside diameter of the cleaning brush 116 as 14 mm, and the number of teeth of the gear G4 as 18, for the linear speed V1 of the feed roller 112, the linear speed V2 of the cleaning brush 116 is 1.49, and the relative linear speed (V1−V2) is −0.49, and V1<V2 results.

Further, in the example and comparative example, the overlap amounts of the outside diameter of the cleaning brush 116 shifted into the outside diameter of the feed roller 112 are all 1.23 mm.

Figure 6:
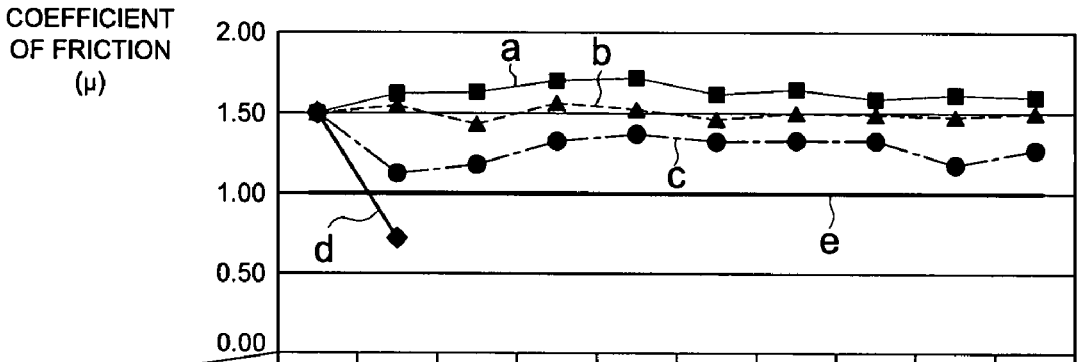
FIG. 6 is a characteristic diagram of the measured results of changes in the coefficient of friction of the outer peripheral surface of the feed roller.

FIG. 6 is a characteristic diagram of the measured results of changes in the coefficient of friction of the outer peripheral surface of the feed roller 112.

With respect to the cleaning system, the four systems indicated below are compared and investigated.

(a) Example

The rotary cleaning brush 116 is used, and the cleaning brush 116 and feed roller 112 are rotated in the same tangential forward direction at the sliding contact position, and assuming the linear speed of the outer peripheral surface of the feed roller 112 during rotation as V1 and the linear speed of the sliding contact section at the tip of the cleaning brush 116 as V2, V1>V2 is set.

(b) Comparative Example 1

The rotary cleaning brush 116 is used, and the cleaning brush 116 and feed roller 112 are rotated in the same tangential forward direction at the sliding contact position, and assuming the linear speed of the outer peripheral surface of the feed roller 112 during rotation as V1 and the linear speed of the sliding contact section at the tip of the cleaning brush 116 as V2, V1<V2 is set.

(c) Comparative Example 2

The rotary cleaning brush 116 is used and the cleaning brush 116 and feed roller 112 are rotated in the tangential opposite direction at the sliding contact position.

(d) Comparative Example 3

A sheet feeding device having an arranged fixed cleaning brush shown in FIG. 5.

When the roller surface is stained by dusting powder, paper dust, and ink sludge, in the surface states of the pickup roller 111 and feed roller 112, as the surface roughness Rz (ten-point average roughness) gets worse, a higher coefficient of friction μ is obtained.

In the sheet feeding device of the present invention, when the electromagnetic clutch CL is connected, for the pickup roller 111 and feed roller 112, the cleaning brush 116 rotates in the same direction in the linear speed relationship of V1>V2 and stains of foreign substances such as paper dust, dusting powder, and ink sludge are transferred from the pickup roller 111 and feed roller 112 to the cleaning brush 116. Foreign substances adhered to the cleaning brush 116 are collected by the second cleaning member 117 and then is removed by the third cleaning member 118.

When the electromagnetic clutch CL is disconnected, the feed roller 112 is drawn by the sheets S held and conveyed by the conveyance roller pair 115 and is rotated at the linear speed V1, though the cleaning brush 116 is stopped, and the linear speed V2 of the tip of the cleaning brush 116 is zero. However, also in this state, the pickup roller 111 and feed roller 112 are driven to rotate at the linear speed V1, so that the relationship of linear speeds of V1>V2 is kept unchanged. While the cleaning brush 116 is stopped, foreign substances collected at a predetermined location of the cleaning brush 116 are collected by the second cleaning member 117 at feed start time of the succeeding sheets S and then are removed by the third cleaning member 118.

Further, also in the second sheet feeding unit 12 shown in FIG. 2, the cleaning brush 123 rotating forward in the linear speed relationship of V1>V2 cleans the outer periphery surface of the conveying roller 121 in contact with it. Further, the cleaning brush 123 is refreshed by the second cleaning member 124 and is cleaned more surely by the third cleaning 125.

Generally, the pickup roller 111 and feed roller 112 which are covered with EDPM rubber with a high coefficient of friction μ have high sheet conveying force at an early stage of print, while when feeding off-set printed sheets S, dusting powder, paper dust, and ink sludge adhered to the sheets S before feeding are transferred onto the roller surface and are hardly removed, thus the durability of sheet conveyance is lowered. The reason is that the EDPM rubber with a high coefficient of friction μ has a property of easily pulling in foreign substances such as dusting powder, paper dust, and ink sludge inside the rubber.

(a) In the rotation system of the cleaning brush 116 in the linear speed relationship of V1>V2 indicated in the example, the coefficient of friction μ is high in continuous feed of up to 9000 sheets and stable high conveying force is obtained.

(b) In the rotation system of the cleaning brush 116 in the linear speed relationship of V1<V2 indicated in Comparative Example 1, although the coefficient of friction μ is lower than that of the example aforementioned, an almost stable coefficient of friction μ is obtained in continuous feed of up to 9000 sheets.

(c) In the form of reversing the cleaning brush 116 indicated in Comparative Example 2, the coefficient of friction is lowered and the coefficient of friction μ is changed greatly.

(d) In the fixed brush form, the coefficient of friction μ is suddenly lowered in continuous feed of about 200 sheets from the early stage of continuous feed down to the lower limit of sheet feed performance and when the continuous feed of sheets is continued, the coefficient of friction μ is lowered under the lower limit of sheet feed performance, thus defective sheet feed is caused.

Further, in the embodiment of the present invention, as a finisher connected to the image forming apparatus main body A, the finisher having the flat binding function is explained. However, the finisher of the image forming apparatus of the present invention is not limited to it and can be applied to a sheet feeding device of a finisher such as a pasting bookbinding device, a small paper cutter, a cover-wrapping bookbinding device, and a sealing device.

Further, in the embodiment of the present invention, the finisher connected to a copier is explained. However, the finisher can be applied to an image forming system connected of an image forming apparatus such as a light printing machine, a printer, a facsimile, and a multi-functional machine.

The present invention can provide a foreign substance removing device for enabling removal of foreign substances such as paper dust over a long period of time, reducing entry of foreign substances into the transfer area, realizing miniaturization of the cleaning mechanism, and obtaining a good image quality and an image forming apparatus using the concerned device.

Furthermore, improvement of the cleaning effect and durability of the first sheet feeding member and second sheet feeding member, improvement of the conveyability of paper-dusty sheets, and improvement of the conveyability of offset-printed sheets, particularly offset-printed coated paper can be realized effectively.

What is claimed is:

1. A sheet feeding device comprising:

(a) a conveying member of a conveying unit which conveys a sheet, the conveying unit comprising:

a first sheet feeding unit which interposes and conveys a sheet by coming into pressure contact with an uppermost surface of sheets stored in a sheet storing section, the first sheet feeding unit comprising:

a first conveying member which comes in pressure contact with the uppermost surface of the sheets stored in the sheet storing section to feed a sheet; and a second conveying member provided downstream of the first sheet conveying member in the sheet conveyance direction, which separates and interposes the sheet which has been conveyed by the first sheet conveying member to convey toward the downstream side; and a pair of conveyance rollers provided downstream of the first sheet feeding unit in a sheet conveyance direction, which further conveys the sheet which has been conveyed by the first sheet feeding unit toward a downstream side; and (b) a cleaning member which is in sliding contact with a circumferential surface of the conveying member to clean the circumferential surface, wherein the conveying member and the cleaning member rotate in the same tangential direction at a sliding contact position thereof, and drives of the conveyance member and the cleaning member are controlled so that the following expression is satisfied:

$$V1>V2$$

where V1 represents a line speed of the circumferential surface of the conveying member during a rotation thereof, and V2 represents a line speed of a sliding contact portion of the cleaning member during a rotation thereof;

the cleaning member is a cleaning brush which is rotated by a driving unit; and the cleaning member cleans the first conveying member and the second conveying member by coming into sliding contact with the first conveying member and the second conveying member.

2. The sheet feeding device of claim 1, wherein the drive of the first sheet feeding unit is stopped after the sheet is conveyed by the first sheet feeding unit, the sheet is interposed and conveyed by the pair of conveyance rollers, during which the second conveying member of the first sheet feeding unit is rotated following a conveyance of the sheet.

3. The sheet feeding device of claim 1, wherein when the drive of the conveying unit is stopped, the rotation of the cleaning member is also stopped.

4. The sheet feeding device of claim 1, further comprising a second cleaning member rotated by the driving unit, which is in sliding contact with the cleaning member to remove a paper dust or a foreign substance that has been adhered to the cleaning member.

5. The sheet feeding device of claim 4, further comprising a third cleaning member formed by a flexible thin plate, a tip of which is in contact with an outer circumferential surface of the second cleaning member counter to a rotation thereof to remove a paper dust or a foreign substance that has been adhered to the second cleaning member, and shields an upper space of the conveying member.

6. The sheet feeding device of claim 5, further comprising a covering member formed by a flexible thin plate and provided in a position opposite to the third cleaning member with respect to the second cleaning member, a tip of which is in contact with an outer circumferential surface of the second cleaning member with trailing a rotation thereof to remove the paper dust or the foreign substance that has been adhered to the second cleaning member, and shields the upper space of the conveying member.

7. An image forming apparatus comprising:

the sheet feeding device of claim 1; and an image forming section which forms an image onto a sheet fed by the sheet feeding device.

* * * * *